US012495950B2

(12) United States Patent
Agrawal et al.

(10) Patent No.: US 12,495,950 B2
(45) Date of Patent: Dec. 16, 2025

(54) UNIVERSAL INNER MEMBER FOR A SLIDE ASSEMBLY OF A DISHWASHER APPLIANCE

(71) Applicant: Haier US Appliance Solutions, Inc., Wilmington, DE (US)

(72) Inventors: Abhisek Agrawal, Louisville, KY (US); Justin Daniel Ryan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 182 days.

(21) Appl. No.: 18/352,134

(22) Filed: Jul. 13, 2023

(65) Prior Publication Data

US 2025/0017441 A1 Jan. 16, 2025

(51) Int. Cl.
*A47L 15/00* (2006.01)
*A47L 15/50* (2006.01)

(52) U.S. Cl.
CPC ..... *A47L 15/507* (2013.01)

(58) Field of Classification Search
CPC ... A47L 15/507; A47L 15/0084; A47B 88/40; A47B 88/403; A47B 88/423; A47B 88/43; A47B 88/437; A47B 88/493; A47B 88/401; A47B 88/57; A47B 2210/17; A47B 2210/0059; A47B 2088/4278
USPC ..... 312/228.1, 333, 334.44, 334.46, 334.47, 312/334.7, 334.9, 334.15, 228; 211/41.8
See application file for complete search history.

(56) References Cited

U.S. PATENT DOCUMENTS

| | | | | |
|---|---|---|---|---|
| 3,904,254 | A * | 9/1975 | Hagen | F16C 29/048 312/334.47 |
| 5,403,097 | A * | 4/1995 | Woof | F16C 29/04 384/23 |
| 6,416,145 | B1 | 7/2002 | Singh | |
| 6,715,851 | B1 * | 4/2004 | Yang | A47B 88/493 312/334.46 |
| 8,528,994 | B2 * | 9/2013 | Simmons | A47L 15/0084 312/334.7 |
| 10,201,230 | B2 | 2/2019 | Min | |
| 10,376,054 | B1 * | 8/2019 | Chen | A47B 88/50 |
| 10,820,783 | B2 | 11/2020 | Lam | |
| 10,823,493 | B2 | 11/2020 | Lindel et al. | |
| 2012/0049712 | A1 * | 3/2012 | Lobbezoo | A47B 88/493 384/51 |
| 2014/0306588 | A1 * | 10/2014 | Cordill | A47L 15/4257 312/228 |
| 2018/0184806 | A1 * | 7/2018 | Min | A47L 15/507 |

(Continued)

FOREIGN PATENT DOCUMENTS

| | | | |
|---|---|---|---|
| CN | 111329422 A | * | 6/2020 |
| CN | 113662374 A | * | 11/2021 |

(Continued)

*Primary Examiner* — Janet M Wilkens
(74) *Attorney, Agent, or Firm* — Dority & Manning, P.A.

(57) ABSTRACT

A dishwasher includes a tub that includes a tub side wall. The dishwasher appliance also includes a slide assembly mounted to the tub side wall. The slide assembly includes a universal inner member that includes a front slot, a back slot, and a center tab. The front slot and the back slot each defined the universal inner member. The center tab is located between the front slot and the back slot approximately along a first direction. The slide assembly also includes a slide apparatus attached to the universal inner member.

14 Claims, 12 Drawing Sheets

(56) References Cited

U.S. PATENT DOCUMENTS

| | | | | |
|---|---|---|---|---|
| 2020/0022559 | A1 | 1/2020 | Lam et al. | |
| 2020/0128961 | A1* | 4/2020 | Min | A47B 88/477 |
| 2023/0117541 | A1* | 4/2023 | Dunaway | A47L 15/507 211/41.8 |
| 2024/0415368 | A1* | 12/2024 | Agrawal | A47L 15/507 |

FOREIGN PATENT DOCUMENTS

| | | | | | |
|---|---|---|---|---|---|
| CN | 220588220 | U | * | 3/2024 | A47L 15/0034 |
| DE | 102013211560 | A1 | | 12/2014 | |
| FR | 2608905 | A1 | * | 7/1988 | A47B 88/57 |
| KR | 20220059738 | A | * | 5/2022 | |
| WO | WO-9847410 | A1 | * | 10/1998 | A47B 88/427 |
| WO | WO-2019191793 | A1 | * | 10/2019 | A47B 88/427 |
| WO | WO-2024235448 | A1 | * | 11/2024 | |

* cited by examiner

UNIVERSAL INNER MEMBER FOR A SLIDE ASSEMBLY OF A DISHWASHER APPLIANCE

FIELD

The present subject matter relates generally to dishwasher appliances, and more particularly to a universal inner member for a slide assembly of a dishwasher appliance.

BACKGROUND

Dishwasher appliances generally include a tub that defines a wash chamber. Rack assemblies can be mounted within the wash chamber of the tub for receipt of articles for washing. Conventional dishwasher appliances include slide assemblies for supporting one or more dish racks within the wash chamber and enabling movement of the dish racks in and out of the wash chamber. Manufacturers typically offer different styles and configurations of slide assemblies, e.g., roller slide assemblies and ball bearing slide assemblies, which may be used in dishwasher appliances.

Notably, the different styles and configurations of slide assemblies may be formed from different parts and may be attached to the interior of the tub in different ways. For instances, each style of slide assembly may include a specific slide that may enable movement of the slide assembly. As a result, the desired configuration of the slide assemblies must be known early in the production process, potentially causing longer lead times, complicating part procurement and storage, and raising costs. Furthermore, the differences between the various slide assemblies may require different production processes, thereby increasing manufacturing complexity, further raising costs, and increasing the risk of assembly errors.

Accordingly, a dishwasher appliance that utilizes a common attachment member that various styles and configurations of slides may each be attached to would be useful.

BRIEF DESCRIPTION

Aspects and advantages of the invention will be set forth in part in the following description, or may be apparent from the description, or may be learned through practice of the invention.

In one exemplary embodiment, a dishwasher appliance is provided. The dishwasher appliance may define a vertical direction, a lateral direction, and a transverse direction. The dishwasher appliance may include a tub that may define a wash chamber. The tub may include a first tub side wall and a second tub side wall. The dishwasher appliance may also include a first slide assembly mounted to the first tub side wall at a vertical height. The first slide assembly may include a first universal inner member that may include a first front slot and a first back slot each defined therethrough. The first front slot and the first back slot may be spaced apart approximately along the transverse direction. The first universal inner member also includes a first center tab located between the first front slot and the first back slot. The first slide assembly may also include a first slide apparatus attached to the first universal inner member. The dishwasher appliance may further include a second slide assembly mounted to the second tub side wall at the vertical height. The second slide assembly may include a second universal inner member that includes a second front slot and a second back slot each defined therethrough. The second front slot and the second back slot may be spaced apart approximately along the transverse direction. The second universal inner member also may include a second center tab located between the second front slot and the second back slot. The second slide assembly may also include a second slide apparatus attached to the second universal inner member.

In another exemplary embodiment, a dishwasher appliance is provided. The dishwasher appliance may include a tub that may include a tub side wall. The dishwasher appliance may also include a slide assembly mounted to the tub side wall. The slide assembly may include a universal inner member that may include a front slot and a back slot that each may be defined through the universal inner member. The universal inner member may also include a center tab that may be located between the front slot and the back slot. The slide assembly may also include a slide apparatus attached to the universal inner member.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
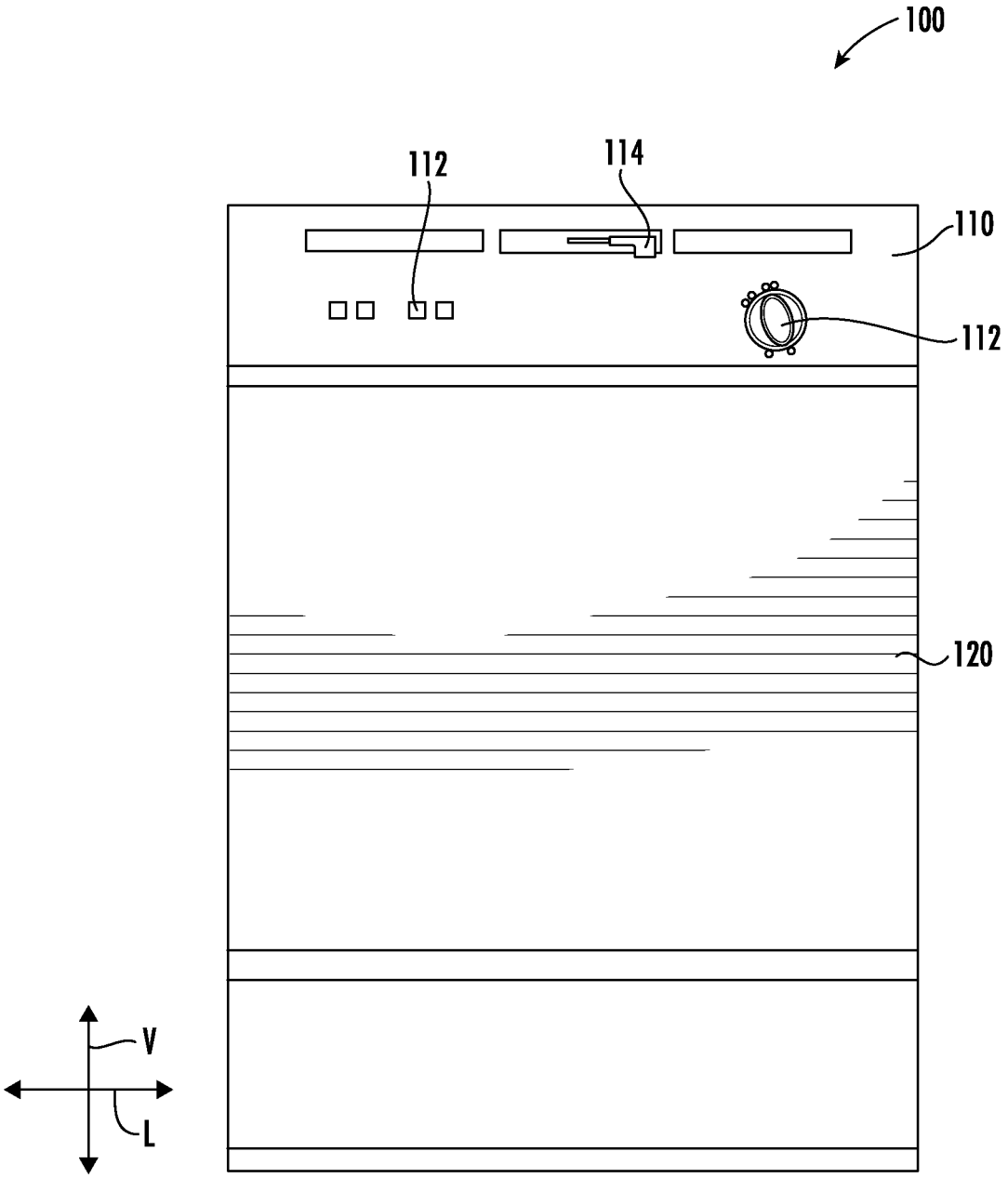
FIG. 1 provides a front elevation view of a dishwasher appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
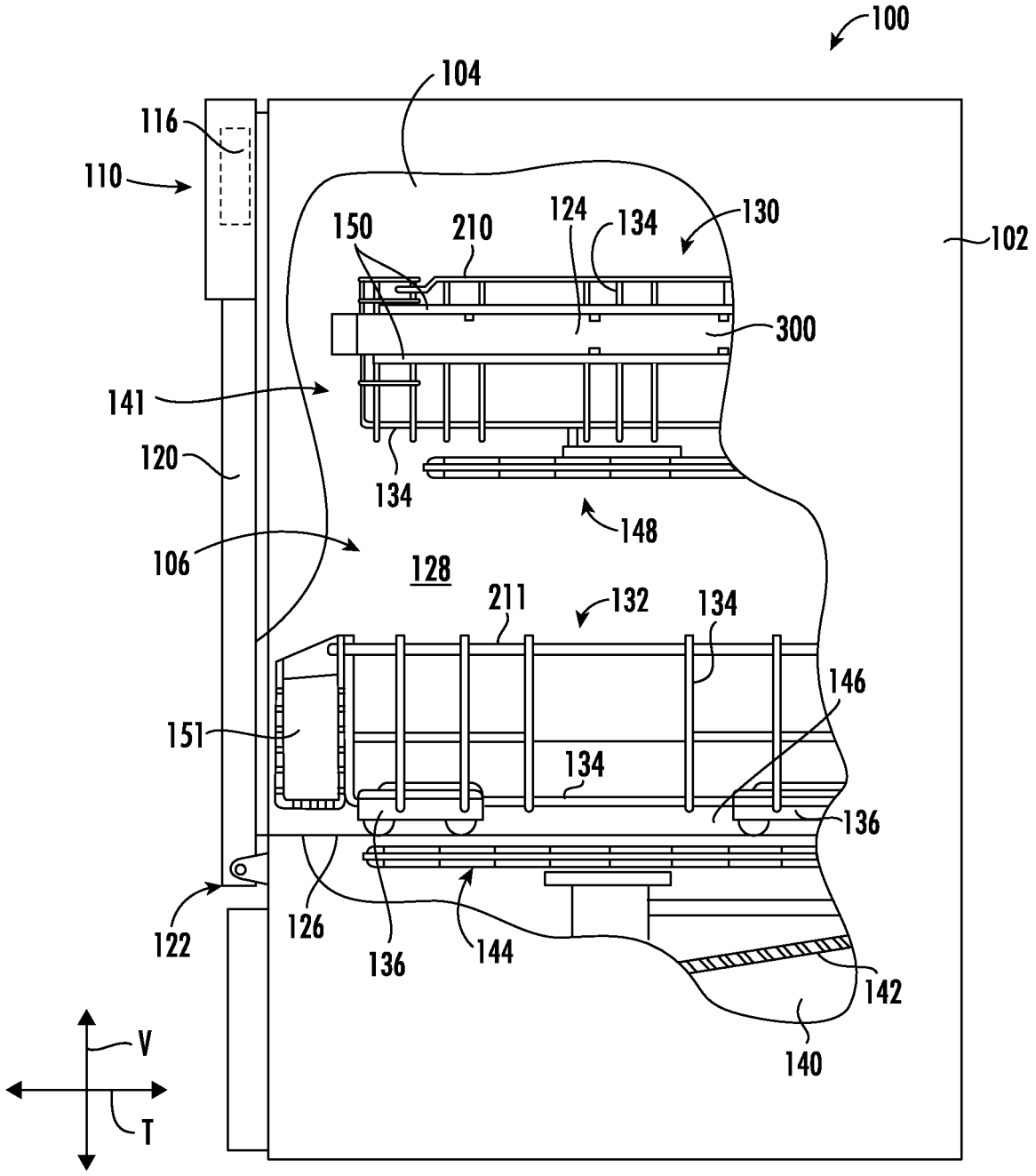
FIG. 2 provides a side, partially cut away view of the exemplary dishwasher appliance of FIG. 1.

Referring now to FIGS. 1 and 2, a dishwasher appliance 100 according to one or more exemplary embodiments of the present subject matter is provided. Specifically, FIG. 1 provides a front elevation view of the dishwasher appliance 100 and FIG. 2 provides a side, partially cut away view of the dishwasher appliance 100 of FIG. 1. As depicted, the dishwasher appliance 100 may define a vertical direction V, a lateral direction L, and a transverse direction T. The vertical direction V, the lateral direction L, and the transverse direction T each being mutually perpendicular with every other, such that an orthogonal direction system is generally defined.

The dishwasher appliance 100 may include a cabinet 102 having a tub 104 therein that defines a wash chamber 106. For example, the tub 104 may include a plurality of walls which may form the boundaries of and define the wash chamber 106, such as on five sides of the wash chamber 106. For example, the plurality of walls of the tub 104 may include a pair of tub side walls 128, as described further below. The tub 104 may include a front opening and a door 120 that may be hinged at a bottom 122 for movement between a normally closed vertical position (FIGS. 1 and 2), wherein the wash chamber 106 is sealed shut for washing operation, and a horizontal open position (not depicted), wherein the loading and unloading of articles from the dishwasher appliance 100 may occur. In some instances, such as depicted in FIG. 1, the dishwasher appliance 100 may include a latch 114 that may be used to lock and unlock the door 120 such that access to the wash chamber 106 may be permitted or restricted.

In addition, the dishwasher appliance 100 may include one or more rack assemblies, such as an upper rack assembly 130 and a lower rack assembly 132, that may be used to load articles in the dishwasher appliance 100. In some instances, the upper rack assembly 130 may be mounted within the dishwasher appliance 100 in an upper region 141 of the wash chamber 106, e.g., above the lower rack assembly 132 with respect to the vertical direction V. The upper rack assembly 130 and the lower rack assembly 132 may each be adapted for movement substantially along the transverse direction T between an extended loading position (not shown) in which the upper rack assembly 130 and the lower rack assembly 132, respectively, are positioned substantially outside the wash chamber 106 and a retracted position (FIGS. 1 and 2) in which the upper rack assembly 130 and the lower rack assembly 132, respectively, may be located entirely within the wash chamber 106. In some embodiments, the movement of the upper rack assembly 130 may be facilitated by a pair of slide assemblies 124 that may be positioned at opposing lateral sides of the upper rack assembly 130. Additionally, the movement of the lower rack assembly 132 may be facilitated by a pair of roller assemblies 136 that may be positioned at opposing lateral sides of the lower rack assembly 132.

For example, in some embodiments, the pair of slide assemblies 124 may include a first slide assembly and a second slide assembly that each may be mounted to a respective tub side wall 128 of the tub 104 at the same vertical height, e.g., a height approximately along the vertical direction V, within the wash chamber 106. In some embodiments, the tub side walls 128 may be positioned approximately parallel to one another and may be oriented approximately perpendicular to the lateral direction L, such as in a vertical-transverse plane defined by the vertical direction V and the transverse direction T.

The first slide assembly and the second slide assembly may each include a universal inner member 300. In addition, the first slide assembly and the second slide assembly may each include a slide apparatus 150. The universal inner member(s) 300 may be a common attachment for the slide apparatus(es) 150. For instance, the universal inner member 300 may be provided across a variety of dishwasher appliance units, makes, or models wherein any suitable style, configuration, or type of slide apparatus(es) 150 may be attached to the universal inner member(s) 300, respectively. Thus, "universal" may generally refer to the universal inner member 300 being used within, e.g., mounted in, various dishwasher appliances with various slide apparatus(es) 150 attached thereto. For example, in some embodiments, the slide apparatus(es) 150 may be roller slides. As another example, in some embodiments, the slide apparatus(es) 150 may be ball bearing slide. As such, the slide apparatus(es) 150 may be a mechanism that, at least in part, facilitates the movement of the first slide assembly and the second slide assembly, respectively.

The upper rack assembly 130 and the lower rack assembly 132 may each include a dishrack for holding articles therein, e.g., for the cleaning of the articles. For instance, the upper rack assembly 130 may include an upper dishrack 210 and the lower rack assembly 132 may include a lower dishrack 211. The upper dishrack 210 and the lower dishrack 211 may each include a plurality of elongated members 134 that may each be extended in the lateral direction L, the transverse direction T, or the vertical direction V. The plurality of elongated members 134 may be wires, rods, or any other suitable member, that may be fabricated into a lattice structure to form the shape of the upper dishrack 210 and the lower dishrack 211, respectively.

Optionally, a silverware basket 151 may be removably attached to the lower rack assembly 132 for placement of silverware, small utensils, and the like, that may be too small to be accommodated by the upper rack assembly 130 and the lower rack assembly 132.

Further, the dishwasher appliance 100 may include a lower spray assembly 144 that may be rotatably mounted within a lower region 146 of the wash chamber 106 and above a tub sump portion 142 so as to rotate in relatively close proximity to the lower rack assembly 132, e.g., in closer proximity to the lower rack assembly 132 than to the upper rack assembly 130. In addition, the dishwasher appliance 100 may include a mid-level spray assembly 148 that may be located approximately in the upper region 141 of the wash chamber 106 and may be attached to, or located in close proximity to, the upper rack assembly 130, e.g., the mid-level spray assembly 148 may be in "close proximity" to the upper rack assembly 130 in that the mid-level spray assembly 148 is closer to the upper rack assembly 130 than to the lower rack assembly 132. In some embodiments an upper spray assembly (not shown) may additionally be located above the upper rack assembly 130.

The lower spray assembly 144, the mid-level spray assembly 148, and the upper spray assembly may be fed by a fluid circulation assembly that may be configured for circulating water and wash fluid in the tub 104. Portions of the fluid circulation assembly may be located in a machinery compartment 140 located below, e.g., approximately along the vertical direction V, the tub sump portion 142 of the tub 104, as generally recognized in the art. Each spray assembly, e.g., the lower spray assembly 144, the mid-level spray assembly 148, and the upper spray assembly, may include an arrangement of discharge ports or orifices for directing washing liquid onto dishes or other articles located in the upper rack assembly 130 and the lower rack assembly 132, respectively. The arrangement of the discharge ports in at least the lower spray assembly 144 may provide a rotational force by virtue of the washing fluid flowing through the discharge ports. The resultant rotation of the lower spray assembly 144 may provide coverage of dishes and other articles with a washing spray.

The dishwasher appliance 100 may further be equipped with a controller 116 to regulate operation of dishwasher appliance 100. The controller 116 may include a memory (e.g., non-transitive memory) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 116 may be positioned in a variety of locations throughout dishwasher appliance 100. For example, as depicted in FIG. 2, the controller 116 may be located within a control panel area 110 of the door 120. In such an embodiment, input/output ("I/O") signals may be routed between the control system and various operational components of dishwasher appliance 100 along a wiring harness that may be routed through bottom 122 of door 120. In certain embodiments, the control panel area 110 may include input components 112 through which a user may select various operational features and modes and monitor progress of the dishwasher appliance 100. For instance, in some embodiments, input components 112 may be a variety of electrical, mechanical or electro-mechanical input devices including rotary dials (FIG. 1), push buttons (FIG. 1), or touch pads, etc. In some embodiments, the control panel area 110 may include a display component, such as a digital or analog display device designed to provide operational feedback to a user. The input components 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 are for illustrative purposes only. For example, different locations may be provided for the input components 112, different configurations may be provided for the upper rack assembly 130 and the lower rack assembly 132, and other differences may be applied as well.

A single slide assembly 124 or a single universal inner member 300 thereof is illustrated in FIGS. 3 through 13 and described in the following corresponding paragraphs for the sake of clarity and simplicity. Those of ordinary skill in the art will understand that the exemplary slide assemblies 124 or universal inner members 300 shown and described in FIGS. 3 through 13 may be one of a pair, e.g., a second slide assembly or second universal inner member may also be provided. For example, the second slide assembly or second universal inner member may be provided opposite the illustrated slide assembly 124 or universal inner member 300, e.g., on an opposite tub side wall 128 at the same vertical height, and may be a substantial duplicate of the illustrated and described slide assembly 124 or universal inner member 300, such as may be a mirrored version of the illustrated and described slide assembly 124 or the universal inner member 300.

Figure 3:
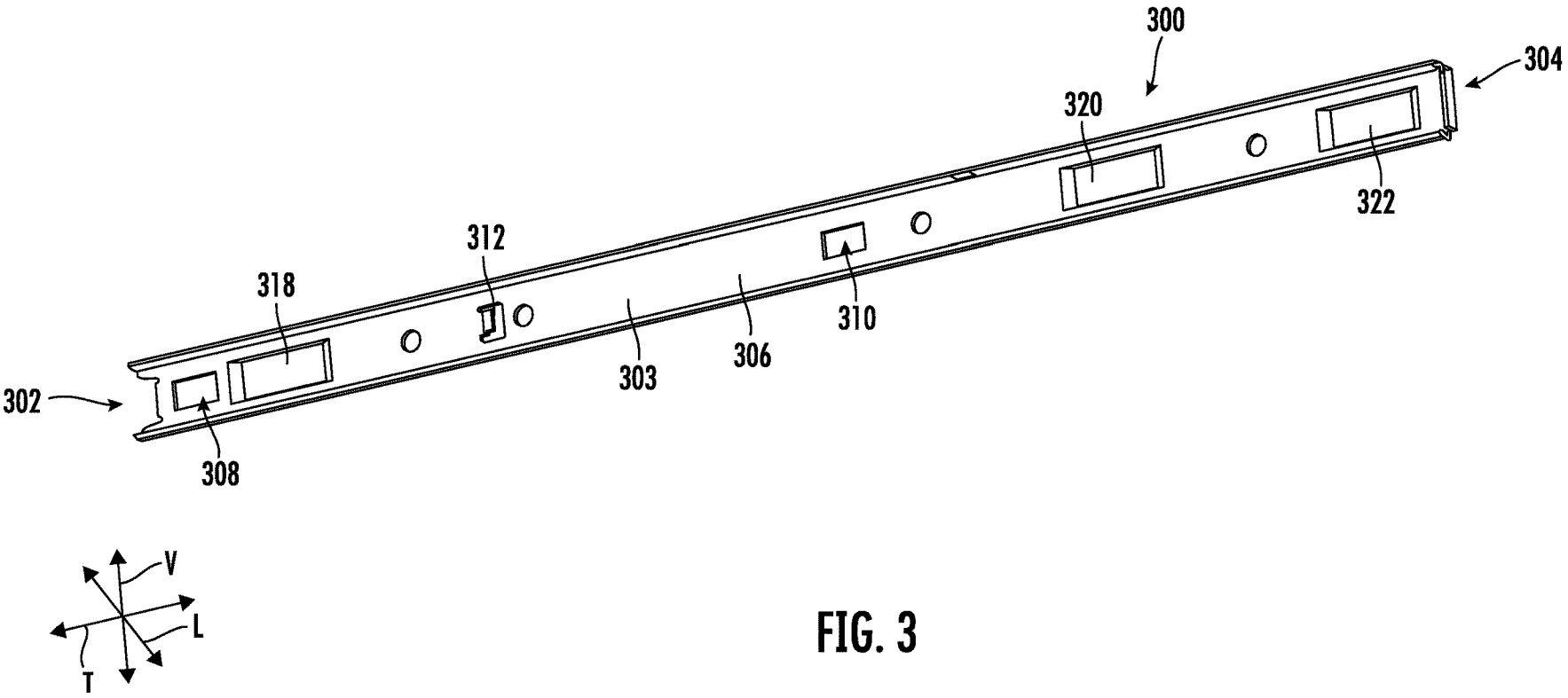
FIG. 3 provides a perspective view of a universal inner member that may be incorporated into the exemplary dishwasher appliance of FIGS. 1 and 2, according to one or more exemplary aspects of the present subject matter.

Referring now to FIG. 3, a perspective view of the universal inner member 300 according to one or more exemplary embodiments of the present subject matter is provided. In some embodiments, the universal inner member 300 may extend approximately along or approximately parallel to the transverse direction T from a front end 302 to a back end 304. In addition, the universal inner member 300 may extend approximately along or approximately parallel to the lateral direction from a first side 303 to a second side 305 (see e.g., FIG. 6). In some embodiments, the universal inner member 300 may be mounted onto the tub side wall 128 of the tub 104 of the dishwasher appliance 100. When the universal inner member 300 may be mounted to the tub side wall 128, the first side 303 may face generally toward the interior of the tub 104 and the second side 305 may face generally toward the respective tub side wall 128.

In some embodiments, the universal inner member 300 may include an inner member body 306 that includes a front slot 308 and a back slot 310 each defined through the inner member body 306. The front slot 308 and the back slot 310 may be elongated slots that may, in some instances, engage with corresponding features of the slide apparatus 150. Moreover, the front slot 308 and the back slot 310 may be spaced apart approximately along the transverse direction T. For example, in some embodiments, such as FIG. 3, the front slot 308 may be positioned proximate the front end 302 of the universal inner member 300, e.g., the front slot 308 may be positioned at the front end 302 or within a front twenty five percent of the transverse length of the universal inner member 300. As another example, the back slot 310 may be positioned proximate the center of the universal inner member 300, e.g., the back slot 310 may be positioned approximately equidistance between the front end 302 and the back end 304, such as approximately within a middle fifty percent of the transverse length of the universal inner member 300.

In addition, in some embodiments, the universal inner member 300 may include a center tab 312 that may be located between the front slot 308 and the back slot 310, e.g., approximately along or approximately parallel the transverse direction T. The center tab 312 may be a universal attachment mechanism, e.g., an attachment mechanism that may engage with numerous styles, variations, and configurations, of slide apparatus. For instance, in some embodiments, the center tab 312 may be used as a locking feature, wherein the center tab 312 may lock, e.g., may be engaged with the slide apparatus 150 to secure the slide apparatus 150 to the universal inner member 300. Additionally, in alternative embodiments, the center tab 312 may be used as a latch that may facilitate the slide apparatus 150 to transition between an engaged position and a disengaged position relative to the universal inner member 300.

Moreover, the center tab 312 may be offset from the inner member body 306 approximately along the lateral direction L such that a generally L-shaped tab may be formed. The center tab 312 may also include a proximal end 314 and a distal end 316 (see e.g., FIG. 8). The proximal end 314 may be connected to the inner member body 306 and the distal end 316 may be free from the inner member body 306, e.g., the distal end 316 may not be directly attached to a surface of the inner member body 306.

In some embodiments, the universal inner member 300 may include one or more recessed portions, for example, the universal inner member 300 may include a first recessed portion 318, a second recessed portion 320, and a third recessed portion 322 that each may be recessed in the lateral direction L. For example, when the universal inner member 300 is mounted onto the tub side wall 128 of the dishwasher appliance 100, the one or more recessed portions may be recessed toward the tub side wall 128. The one or more recessed portions may each have approximately the same lateral depth, e.g., the lateral depth of the first recessed portion 318 may be substantially the same as the lateral depth of the second recessed portion 320. In some embodiments, the universal inner member 300 may be mounted to the tub side wall 128 at the one or more recessed portions. For instance, the universal inner member 300 may be mechanically fastened, and more particular in some embodiments may be permanently mechanically fastened to a tub side wall at the recessed portions by any suitable fastener or process, for instance e.g., bolts, screw, rivets, TOX®, etc.

As will be understood by those skilled in the art, the number of recessed portions depicted are provided by way of example only. In additional embodiments, any suitable number of recessed portions may be provided. For example, in additional embodiments, only two recessed portions may be provided, or more than three recessed portions may be provided, such as four or more recessed portions may be provided.

As described above, the exemplary dishwasher appliance 100 may generally include a tub 104 defining a wash chamber 106 and may include a pair of tub side walls 128 that may be opposed approximately along the lateral direction L. In addition, the exemplary dishwasher appliance 100 may include a pair of slide assemblies 124 that may each include a universal inner member 300 mounted to the tub side wall 128. However, for the embodiment of FIG. 4, the slide apparatus(es) 150 may now be configured as a roller bracket 350.

For the purposes of clarity, only a discrete slide assembly 124 that includes a discrete universal inner member 300 and a discrete roller bracket 350 attached thereto are generally described herein. Nonetheless, it is understood that an identical slide assembly 124 having an identical universal inner member 300 and an identical roller bracket 350 that may mirror the slide assembly 290 described herein.

Figure 4:
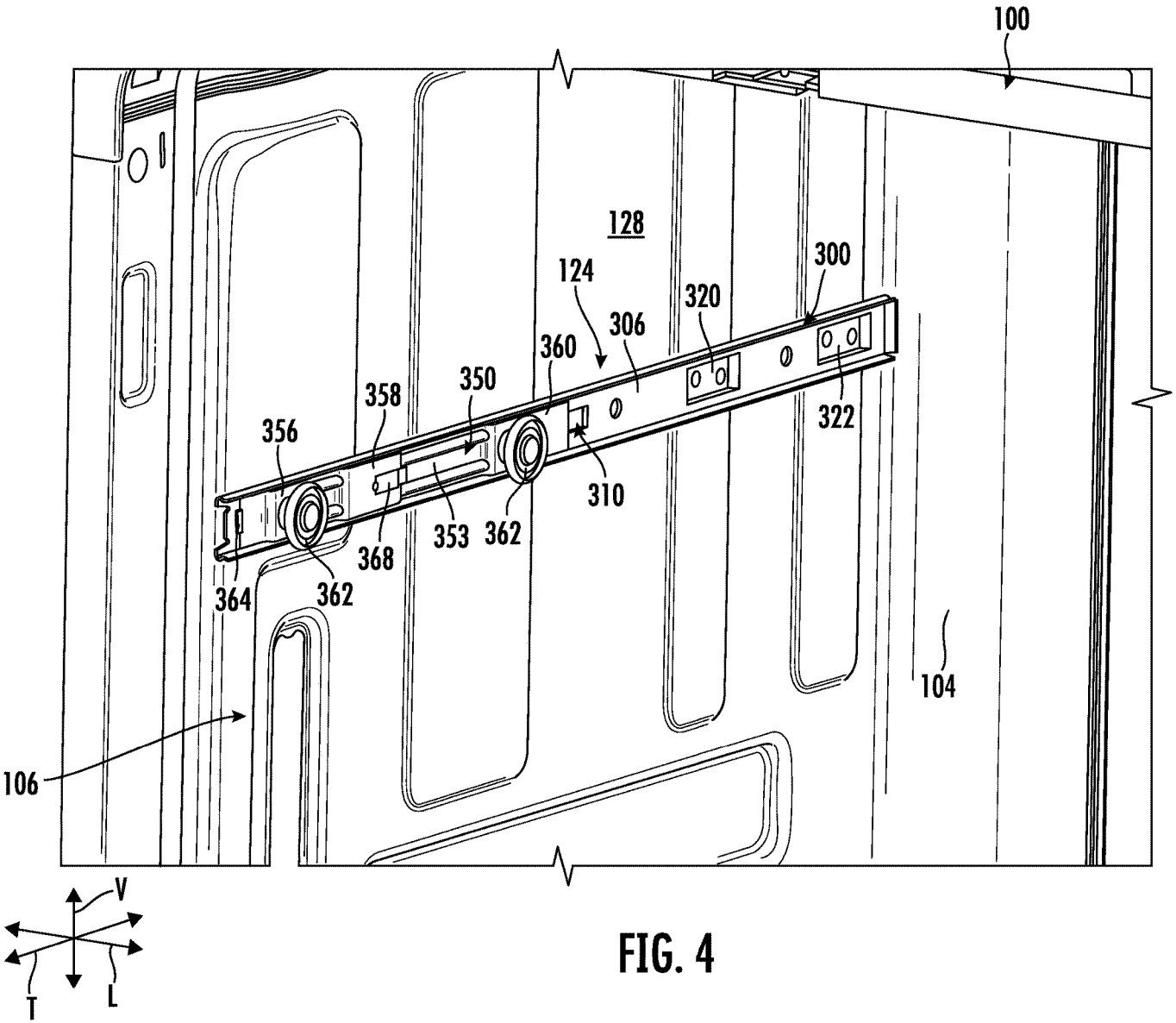
FIG. 4 provides a perspective view of a wash chamber of the exemplary dishwasher appliance of FIGS. 1 and 2 according to one or more exemplary aspects of the present subject matter.
Figure 5:
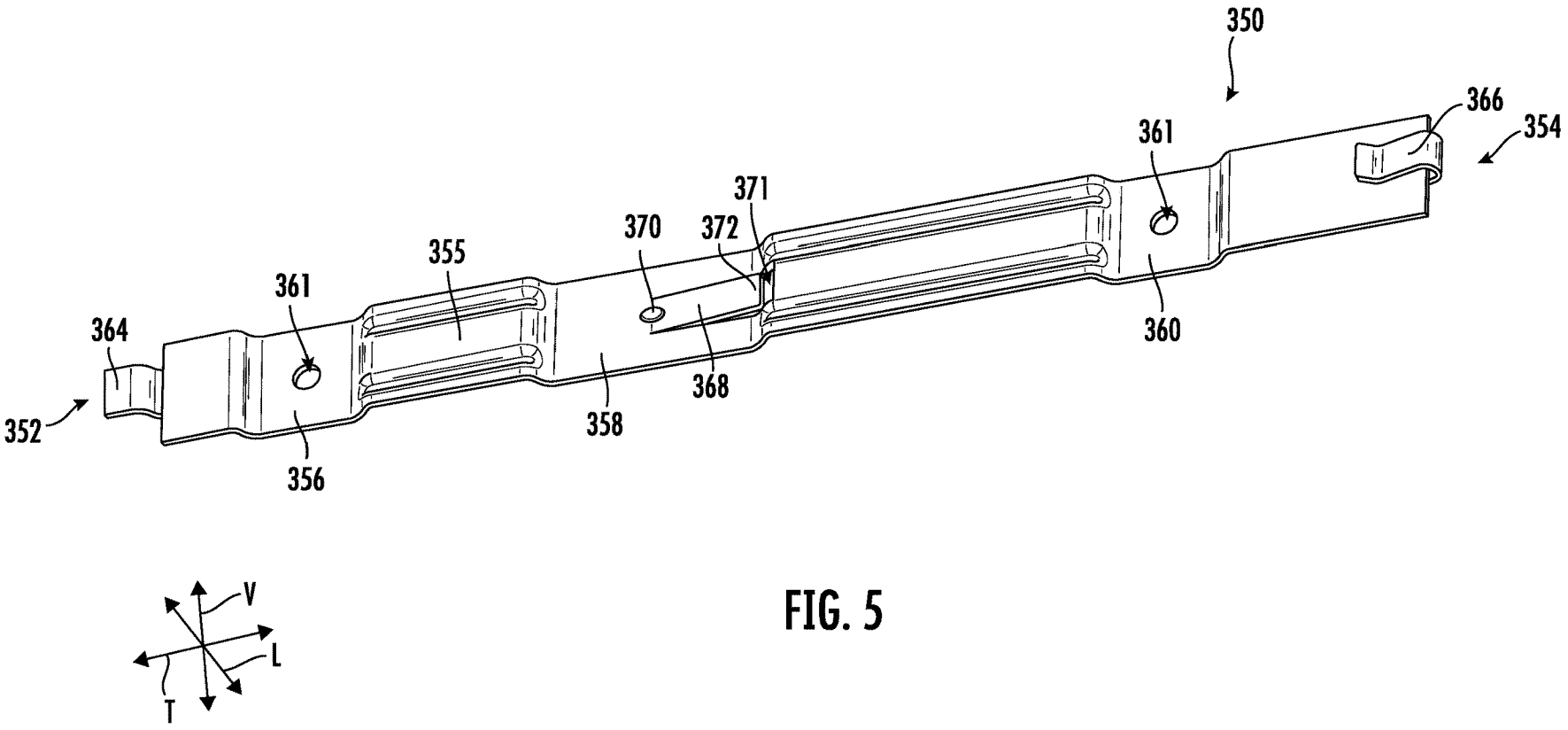
FIG. 5 provides a perspective view of an exemplary roller bracket according to one or more exemplary aspects of the present subject matter.

Referring now to FIGS. 4 and 5, the dishwasher appliance 100 according to one or more exemplary embodiments of the present subject matter is provided. Specifically, FIG. 5 illustrates a perspective view of the wash chamber 106 of the dishwasher appliance 100 and FIG. 5 illustrates a perspective view of a roller bracket 350.

In some embodiments, the roller bracket 350 may extend approximately along or approximately parallel to the transverse direction T from a front end 352 to a back end 354. In addition, the roller bracket 350 may extend laterally, e.g., approximately along or approximately parallel to the lateral direction L, from a first side 353 (see e.g., FIG. 4) to a second side 355.

In some embodiments, the roller bracket 350 may include a front protruded portion 356, a center protruded portion 358, and a back protruded portion 360 that each may be protruded approximately along the lateral direction L, e.g., toward the interior of the tub 104 such as when the roller bracket 350 may be attached to the universal inner member 300 (FIG. 4). The front protruded portion 356, the center protruded portion 358, and the back protruded portion 360 may each have approximately the same lateral extension, e.g., the lateral extension of the front protruded portion 356 may be substantially the same as the lateral extension of the center protruded portion 358 and may also be the same as the back protruded portion 360. In some embodiments, the front protruded portion 356 and the back protruded portion 360 may each include a hole 361 that may each receive a roller wheel 362 (FIG. 4).

Furthermore, in some embodiments, the roller bracket 350 may include a tab 364 that may be positioned at the front end 352 of the roller bracket 350, a hook 366 that may be positioned at the back end 354 of the roller bracket 350, and a center snap fit element 368 that may be positioned between the tab 364 and the hook 366 approximately along the transverse direction T. For instance, in some embodiments, the center snap fit element 368 may be attached to the center protruded portion 358. The center snap fit element 368 may include a secured end 370 and a free end 372. The secured end 370 may be directly attached to the roller bracket 350 and the free end 372 may be free from the roller bracket 350, e.g., may not be directly connected to a surface of the roller bracket 350. In some embodiments, the secured end 370 may act as a hinge, e.g., an actuation point, for the center snap fit element 368. In some embodiments, the center protruded portion 358 may also include an opening 371 defined through the center protruded portion 358. For instance, the opening 371 may be defined through a back end of the center protruded portion 358.

In some embodiments, the center snap fit element 368 may be biased toward an offset position wherein the free end 372 of the center snap fit element 368 may be positioned inward of the center protruded portion 358, e.g., approximately along or approximately parallel to the lateral direction L such as when the roller bracket 350 is attached to the universal inner member 300, and when and the universal inner member is mounted to the tub side wall 128.

Furthermore, in some instances, the center snap fit element 368 may be urged to or toward a compressed position wherein the center snap fit element 368 may be may be moved outward, e.g., approximately along or approximately parallel to the lateral direction L, such as when the roller bracket 350 is attached to the universal inner member 300 and when and the universal inner member is mounted to the tub side wall 128, such that the center snap fit element 368 may be approximately aligned with or approximately parallel to the center protruded portion 358.

Figure 6:
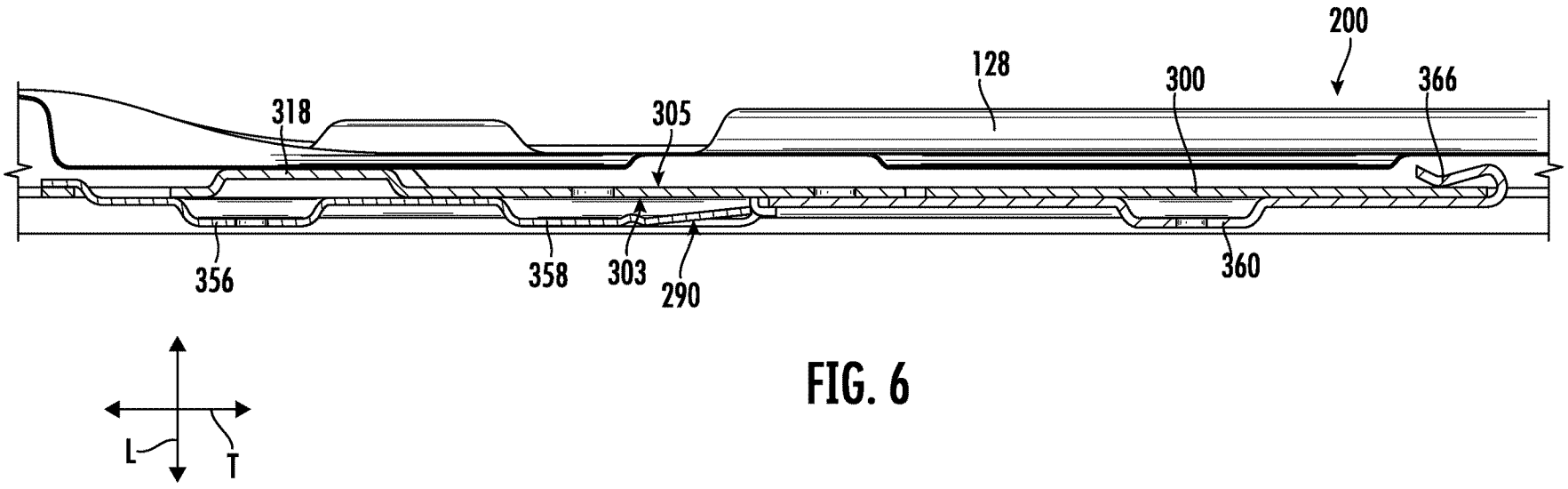
FIG. 6 provides a cross-sectional view of a portion of the exemplary dishwasher appliance of FIG. 4.

Referring now to FIGS. 6 through 9, cross-sectional views of the tub side wall 128 of FIG. 4 are provided according to one or more exemplary embodiments of the present subject matter. Specifically, FIG. 6 provides a cross-sectional view of a portion of the tub side wall 128 having the slide assembly 124 mounted thereto and FIGS. 7 through 9 each provide a close-up view of a portion of FIG. 6.

Figure 7:
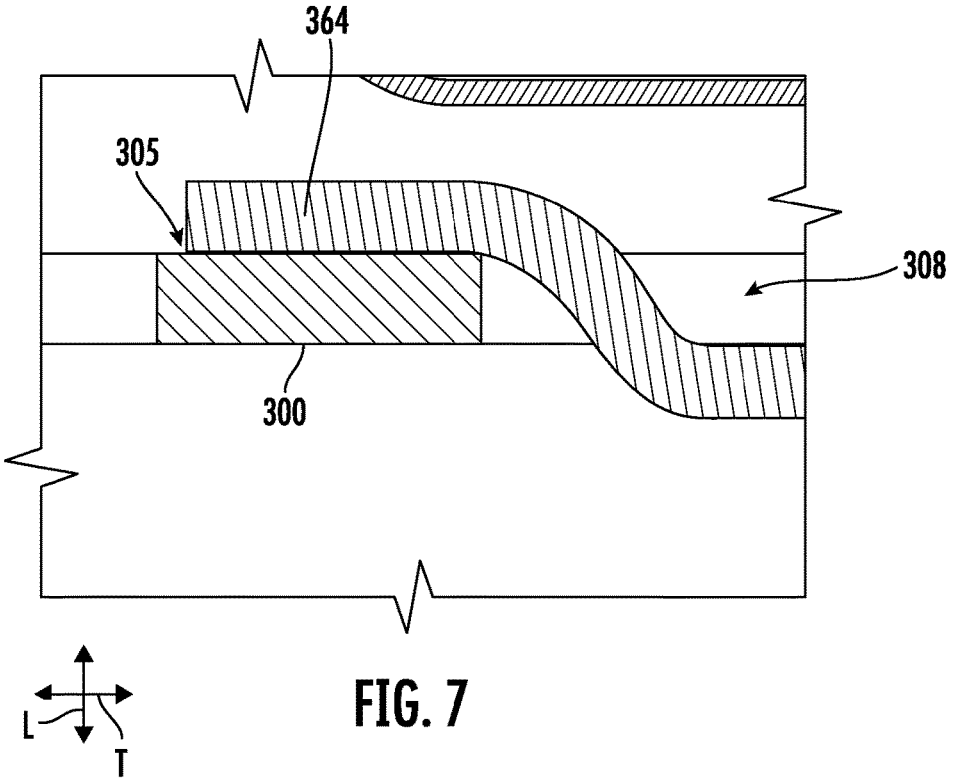
FIG. 7 provides a close-up cross sectional view of a portion of the exemplary slide assembly of FIG. 6.

In some embodiments, the roller bracket 350 may be located to, attached to, and locked to the universal inner member 300. For instance, during a joining operation, e.g., an operation or a condition in which components of the dishwasher appliance 100 may be joined together, such as but not limited to assembly and maintenance of the dishwasher appliance 100, and more particularly the slide assembly 124, the tab 364 of the roller bracket 350 may be located to the universal inner member 300 by engaging the tab 364 of the roller bracket 350 with the front slot 308 of the universal inner member 300. For instance, during the joining operation of the slide assembly 124, the tab 364 may slide through the front slot 308 such that the tab 364 may be interfaced with the second side 305 of the universal inner member 300 (FIG. 7).

Figure 9:
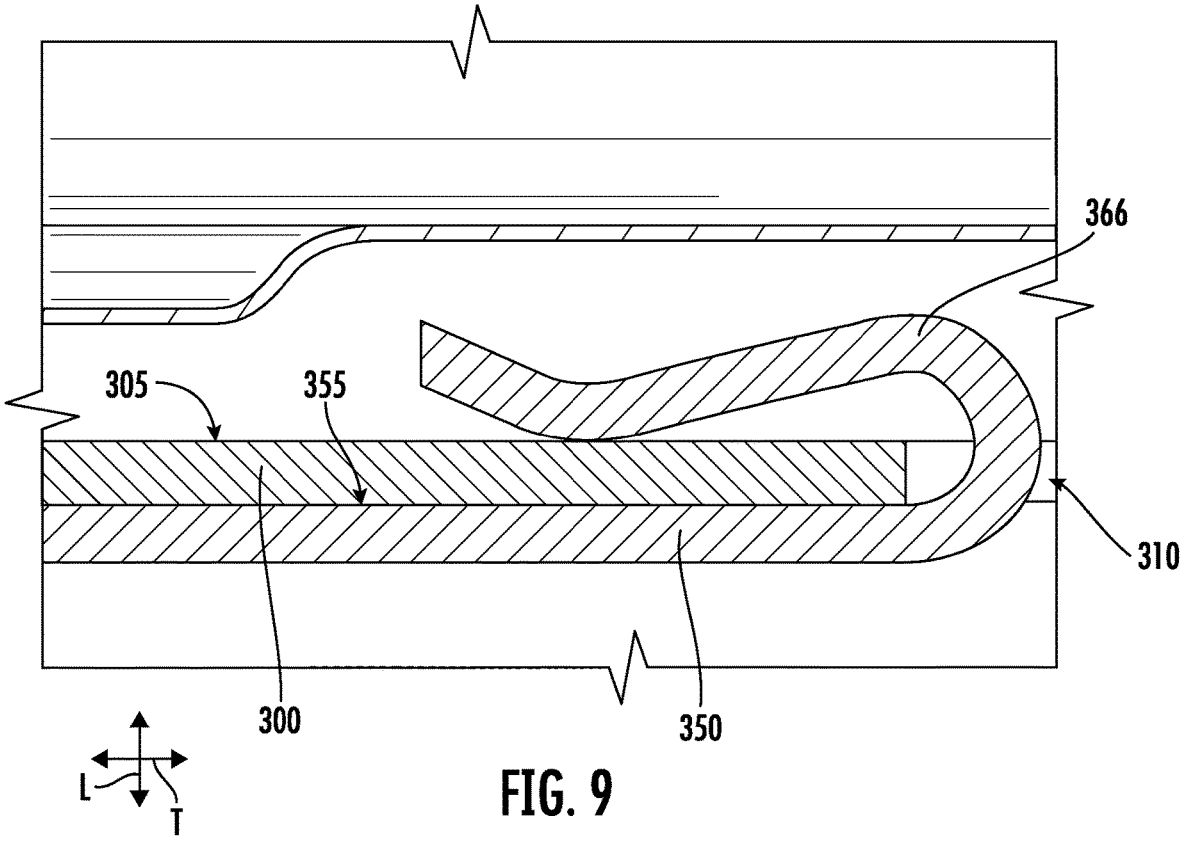
FIG. 9 provides a close-up cross sectional view of yet another portion of the exemplary slide assembly of FIG. 6.

Furthermore, in some embodiments, during the joining operation of the slide assembly 124, the roller bracket 350 may be, at least partially, attached to the universal inner member 300 by the hook 366 interfacing with the second side 305 of the universal inner member 300 (FIG. 9). For instance, the hook 366 may slide through the back slot 310 of the universal inner member 300 wherein the hook 366 may interface with the second side 305 of the universal inner member 300. The hook 366 may be biased toward a closed position, wherein the hook 366 may be urged toward the second side 355 of the roller bracket 350. As such, when the hook 366 is engaged with the universal inner member 300, the hook 366 and the universal inner member 300 may form an interference fit that may, at least partially, attach the roller bracket 350 to the universal inner member 300.

In addition, the center tab 312 of the universal inner member 300 may be positioned such that during the joining operation of the universal inner member 300 and the roller bracket 350, the center tab 312 may pass approximately from the secured end 370 of the center snap fit element 368 to the free end 372 of the center snap fit element 368. As the center tab 312 passes over the center snap fit element 368, the center snap fit element 368 may be urged toward the compressed position, for instance, the center tab 312 may apply a force approximately along or approximately parallel to the lateral direction L, such as a force toward the interior of the tub 104 when the slide assembly 124 is mounted to the tub side wall 128.

Figure 8:
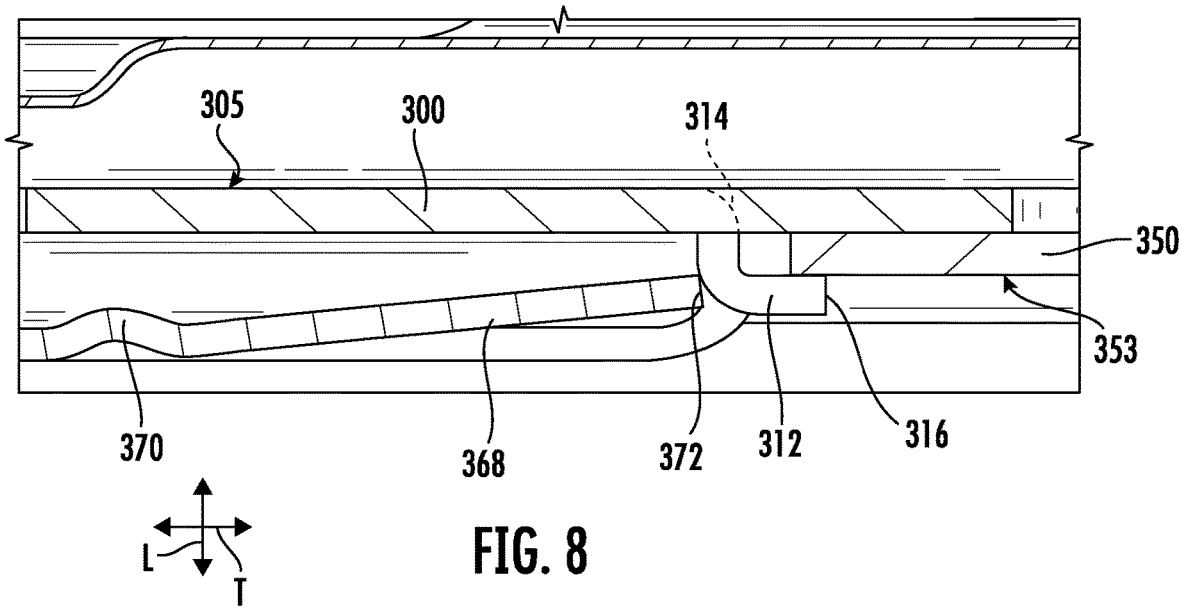
FIG. 8 provides a close-up cross sectional view of another portion of the exemplary slide assembly of FIG. 6.

Moreover, as the center tab 312 is cleared from the free end 372 of the center snap fit element 368, e.g., as the center tab 312 is slide through the opening 371 defined at the back end of the center protruded portion 358 and the proximal end 314 of the center tab 312 has passed the free end 372 of the center snap fit element 368, the center snap fit element 368 may return to the offset position, e.g., as the center snap fit element 368 may be biased toward the offset position (FIG. 8). The center snap fit element 368 may now apply a force approximately along or approximately parallel to the lateral direction L, such as a force toward the tub side wall 128, to the center tab 312 of the universal inner member 300. This force may lock the roller bracket 350 in place relative to the universal inner member 300.

Conversely, to remove the roller bracket 350 from the universal inner member 300 a disengagement operation may be performed. The disengagement operation may be an operation or a condition in which the roller bracket 350 may be disengaged or removed from the universal inner member 300. In some embodiments, the disengagement operation may generally be the reverse order of the joining operation described in more detail above.

For instance, in some embodiments, the disengagement process may be initiated by urging the center snap fit element 368 toward the compressed position. For example, a user of the dishwasher appliance 100 may apply a force approximately along or approximately parallel to the lateral direction L, such as a force toward the interior of the tub 104 when the slide assembly 124 is mounted to the tub side wall 128.

Furthermore, when the center snap fit element 368 may be in the compressed position, the roller bracket 350 may be motivated approximately along the transverse direction T, such as toward a back wall of the dishwasher appliance 100, such that the center tab 312 may pass approximately from the free end 372 of the center snap fit element 368 to the secured end 370 of the center snap fit element 368. In this regard, the tab 364 of the roller bracket 350 may be disengaged from the front slot 308 of the universal inner member 300. For instance, during the disengagement operation of the slide assembly 124, the tab 364 may slide out of the front slide 308 such that the tab 364 may be free from the universal inner member 300. Furthermore, in this regard, the hook 366 may also be disengaged from the universal inner member 300 as the hook 366 may slide out of the slot 310 and may become free from the universal inner member 300.

As mentioned above, the universal inner member 300 may be permanently mounted to the tub side wall 128 such that it may function as a common attachment for various styles and configurations of slide assemblies 124. For instance, in alternative embodiments, the slide apparatus of the slide assembly 124 may not be a roller bracket 350 and may instead be a ball bearing slide 450.

Figure 10:
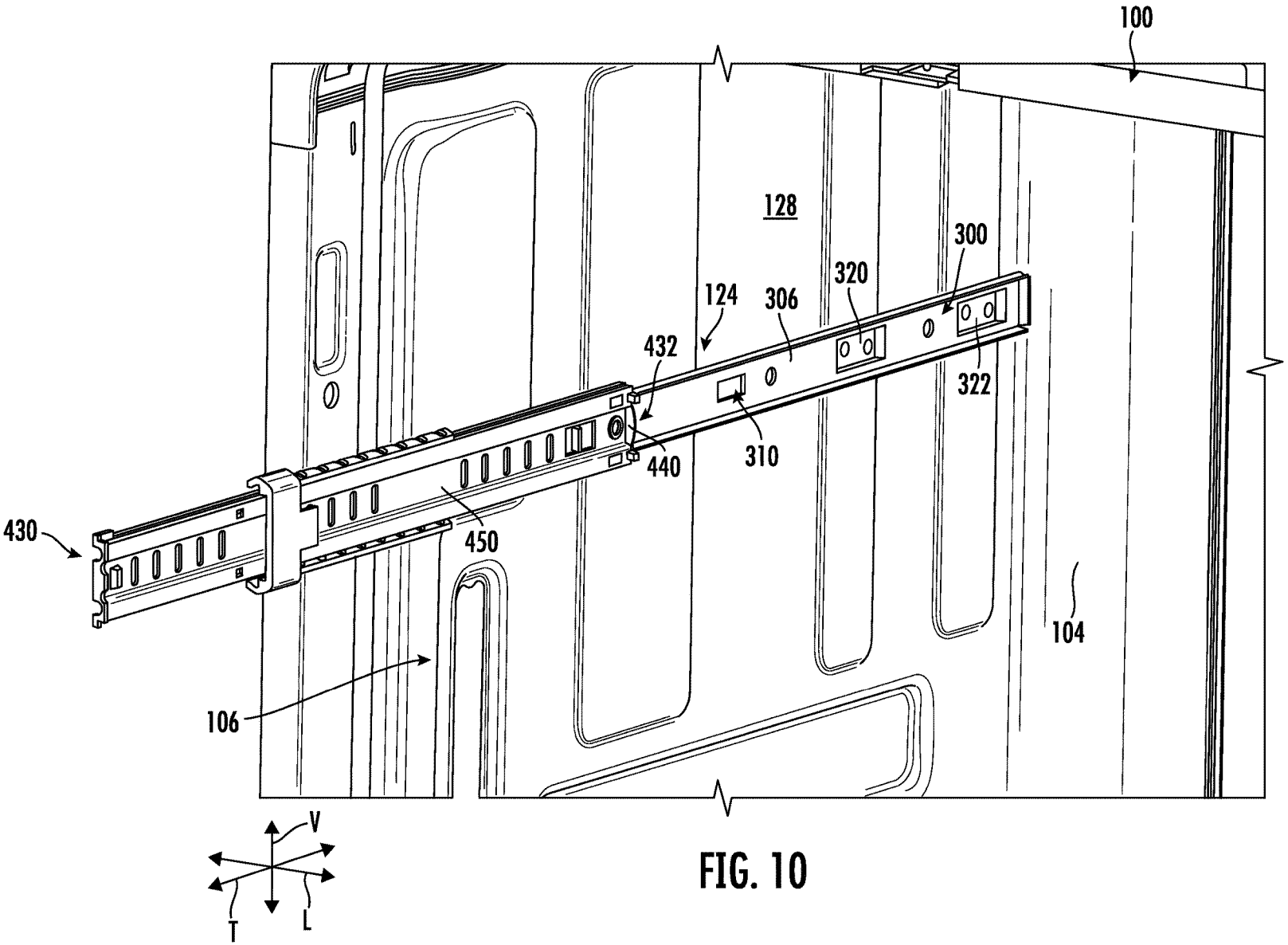
FIG. 10 provides a perspective view of a wash chamber of the exemplary dishwasher appliance of FIGS. 1 and 2 according to one or more exemplary aspects of the present subject matter.
Figure 11:
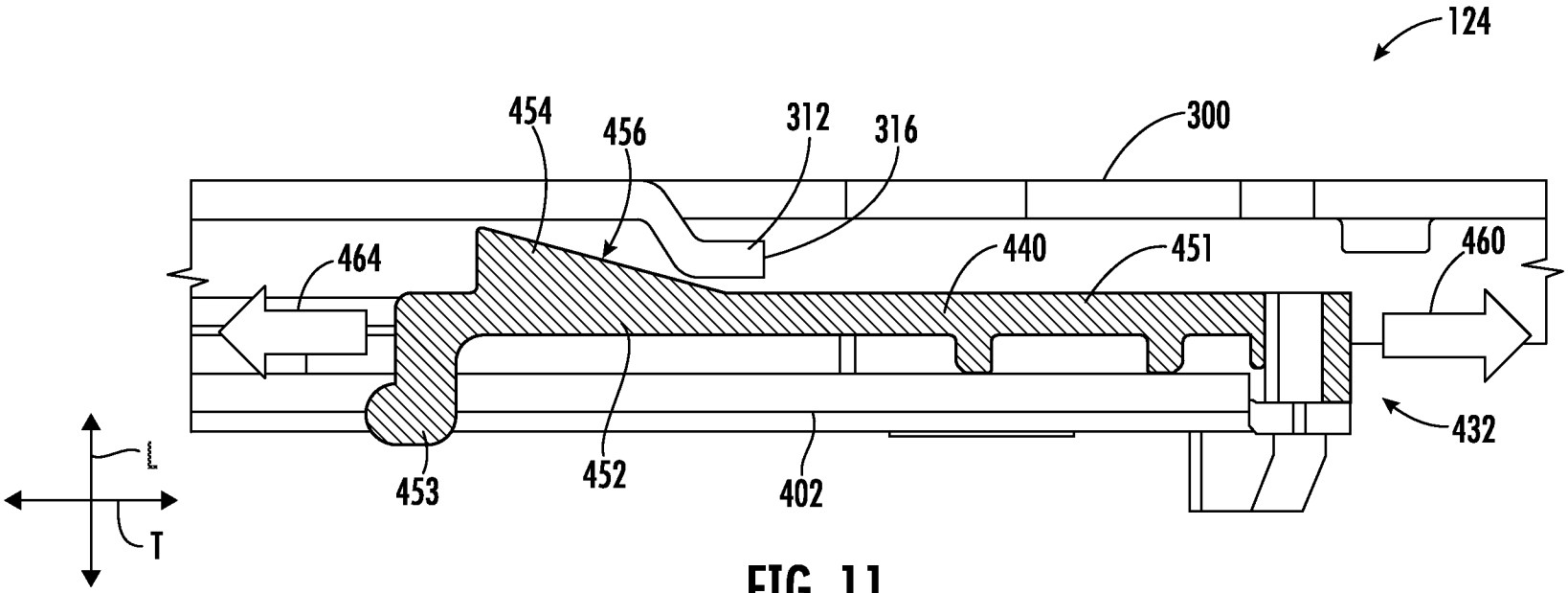
FIG. 11 provides a close-up cross sectional view of a portion of the exemplary slide assembly of FIG. 10.

For example, referring now to FIGS. 10 through 13, the dishwasher appliance 100 according to one or more exemplary embodiments of the present subject matter is provided. Specifically, FIG. 10 illustrates a perspective view of the wash chamber 106 of the dishwasher appliance 100 and FIGS. 11 through 13 each provide a partial cross-sectional view of the exemplary slide assembly 124 of FIG. 10.

As described above, the exemplary dishwasher appliance 100 may generally include a tub 104 defining a wash chamber 106 and may include a pair of tub side walls 128 that may be opposed approximately along the lateral direction L. In addition, the exemplary dishwasher appliance 100 may include a pair of slide assemblies 124 that may each include a universal inner member 300 mounted to the tub side wall 128. However, for the embodiment of FIG. 4, the slide apparatus(es) 150 may now be configured as a ball bearing slide 450.

In some embodiments, the ball bearing slide 450 may be transitionable between an engaged position and a disengaged position relative to the universal inner member 300. For example, in some instances, such as during assembly of the exemplary slide assembly 124, the ball bearing slide 450 may be transitionable from the disengaged position to the engaged position. In other instances, such as during disassembly or maintenance of the exemplary slide assembly 124, the ball bearing slide 450 may be transitionable from the engaged position to the disengaged position.

Moreover, in some embodiments, the ball bearing slide 450 may be in a disengaged position (FIG. 11), wherein the ball bearing slide 450 may not be fully attached to the universal inner member 300 and the ball bearing slide 450 may still be removable from the universal inner member 300. To transition the ball bearing slide 450 from the disengaged position to an engaged position, e.g., a position wherein the ball bearing slide 450 may be slidably mounted to the universal inner member 300, wherein the ball bearing slide 450 may be inhibited from sliding off the universal inner member 300 by the center tab 312, and wherein a ramp 454 of an end cap 440 that may be attached to the ball bearing slide 450 may be a back stop for the ball bearing slide 450, e.g., may inhibit the ball bearing slide 450 from extending beyond an extended loading position, the back end 432 of the ball bearing slide 450 may be slide onto the front end 302 of the universal inner member 300. For example, to transition the ball bearing slide 450 from the disengaged position to the engaged position, a user of the dishwasher appliance 100 may slide the ball bearing slide 450 onto the universal inner member 300 in the direction of arrow 460 (FIG. 11) which may be approximately in the transverse direction T substantially toward a back wall of the tub 104.

Figure 12:
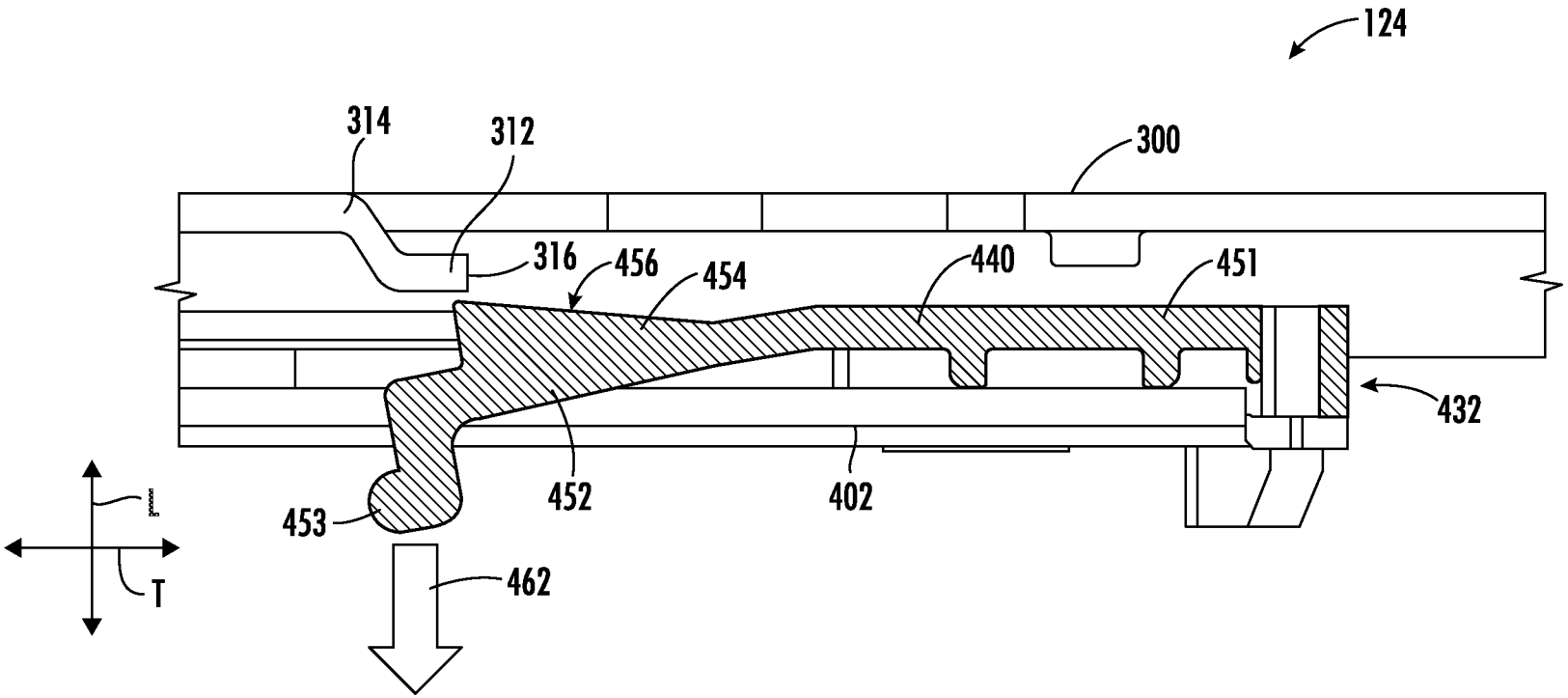
FIG. 12 provides a close-up cross sectional view of a portion of the exemplary slide assembly of FIG. 10.
Figure 13:
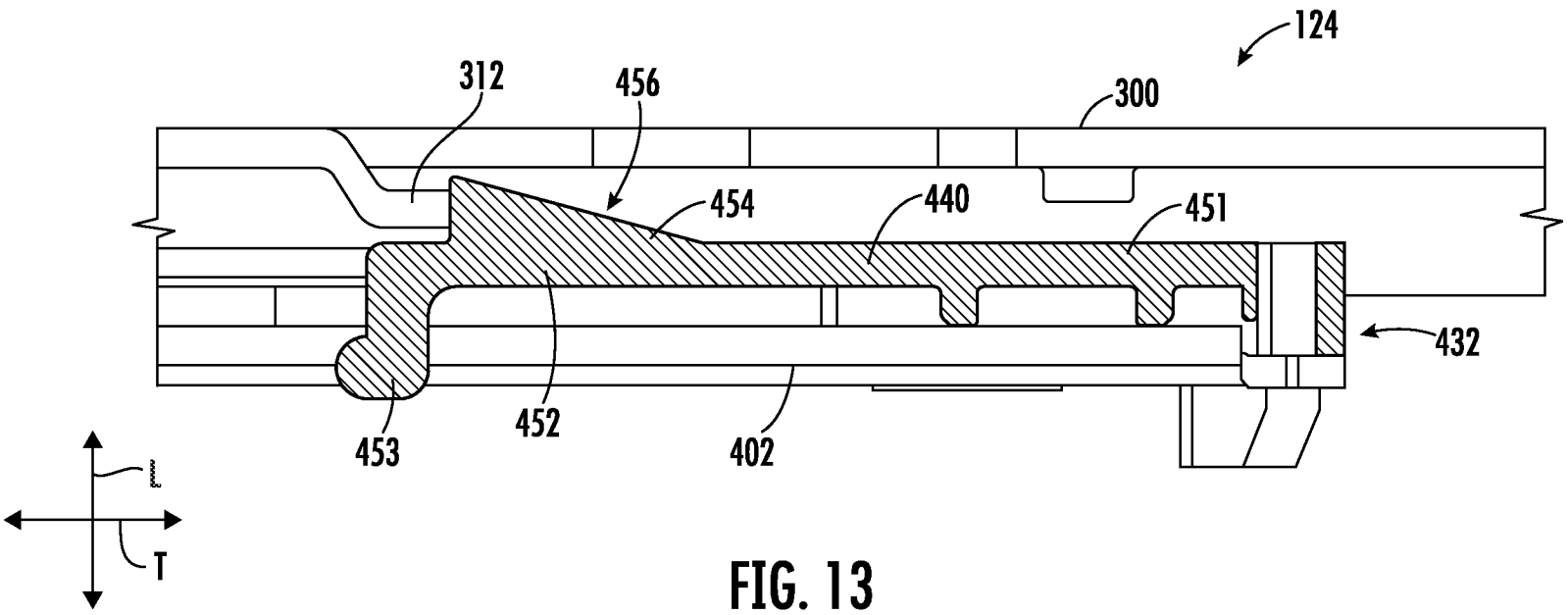
FIG. 13 provides a close-up cross sectional view of a portion of the exemplary slide assembly of FIG. 10.

Moreover, as the ball bearing slide 450 is slid onto the universal inner member 300, e.g., to transition the ball bearing slide 450 from the disengaged position to the engaged position, the center tab 312 of the universal inner member 300 may begin to contact a ramp surface 456 of the lever body 452. As the center tab 312 passes over the ramp 454, and more particularly the ramp surface 456, the center tab 312 may urge the lever body 452 of the end cap 440 to or toward the flexed position, e.g., as the center tab 312 may be relatively rigid when compared to the lever body 452. For instance, as the center tab 312 passes over the ramp surface 456, the lever body 452 may flex outward approximately along or approximately parallel to the lateral direction L relative to the end cap body 451, such as approximately in the direction of arrow 462 (FIG. 12). In some instances, this urging of the lever body 452 to or toward the flexed position may be referred to as a transitionary position, e.g., a position wherein the lever body 452 may be urged to or toward the flexed position such that the ball bearing slide 450 may be permitted to transition between the engaged position and the disengaged position.

Furthermore, as the ball bearing slide 450 is slid further along the universal inner member 300 in the direction of arrow 400, the center tab 312 may pass the front end of the ramp 454 wherein the lever body 452 may transition back to the unflexed position, e.g., as the lever body 452 may be biased toward the unflexed position. The ball bearing slide 450 and the universal inner member 300 may then be engaged as the lever body 452 may now act as a back stop for the ball bearing slide 450. For instance, the lever body 452 may inhibit forward movement, e.g., movement of the ball bearing slide 450 in a direction opposite of the direction of arrow 460, such as in the direction of arrow 464, of the ball bearing slide 450 past the extended loading position.

To transition the ball bearing slide 450 back to the disengaged position, such as during disassembly or maintenance of the slide assembly 124, the process described above may be performed generally in reverse. For instance, to transition the ball bearing slide 450 from the engaged position to the disengaged position, the lever body 452 of the end cap 440 may be pulled into the flexed position (FIG. 12), wherein the lever body 452 of the end cap 440 may be cleared approximately along the lateral direction L from the center tab 312, and wherein the ball bearing slide 450 may be permitted to be removed from the engaged position. For instance, the handle 453 of the lever body 452 may be pulled approximately along the lateral direction L, such as in the direction of arrow 462. For instance, a user may pinch the handle 453, and pull the handle 453 inward when the slide assembly is attached to a tub side wall.

Furthermore, when the lever body 452 is in the flexed position, e.g., when the handle 453 of the lever body 452 is being pulled approximately in the direction of arrow 462, the ball bearing slide 450 may be permitted to slide off the universal inner member 300 as the lever body 452 may be cleared from the center tab 312. The ball bearing slide 450 may then be slid off of the universal inner member 300, e.g., by sliding the ball bearing slide 450 in the direction of arrow 464 (FIG. 11), wherein arrow 464 may be approximately along or approximately along the transverse direction T, such as during disassembly, maintenance, or any suitably condition of the dishwasher appliance 100.

It should be appreciated that the present subject matter is not limited to any particular style, model, or configuration of ball bearing slide. Thus, the exemplary embodiment depicted in FIGS. 10 through 13 are for illustrative purposes only. For example, any suitable engagement mechanism that may engage with a center tab 312 of a universal inner member 300 may be applied as well.

Embodiments of the dishwasher appliance 100 provided herein may advantageously improve manufacturing and assembly of the dishwasher appliance 100 as the universal inner member 300 may decrease manufacturing complexity by providing a common attachment point for various configurations of slide assemblies. In addition, embodiments of the dishwasher appliance 100 provided herein may advantageously lower cost of manufacturing as the universal inner member 300 may be used throughout various models of dishwasher appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a tub defining a wash chamber, the tub comprising a first tub side wall and a second tub side wall;

a first slide assembly mounted to the first tub side wall at a vertical height, the first slide assembly comprising a first universal inner member comprising a first front slot and a first back slot each defined therethrough, the first front slot and the first back slot spaced apart approximately along the transverse direction, the first universal inner member also comprising a first center tab located between the first front slot and the first back slot, and a first roller bracket attached to the first universal inner member, the first roller bracket extending from a first front end to a first back end approximately along the transverse direction, the first roller bracket comprising a first tab positioned at the first front end, a first hook positioned at the first back end, and a first center snap fit element positioned between the first tab and the first hook approximately along the transverse direction; and a second slide assembly mounted to the second tub side wall at the vertical height, the second slide assembly comprising a second universal inner member comprising a second front slot and a second back slot each defined therethrough, the second front slot and the second back slot spaced apart approximately along the transverse direction, the second universal inner member also comprising a second center tab located between the second front slot and the second back slot, and a second roller bracket attached to the second universal inner member, the second roller bracket attached to the second universal inner member, the second roller bracket extending from a second front end to a second back end approximately along the transverse direction, the second roller bracket comprising a second tab positioned at the second front end, a second hook positioned at the second back end, and a second center snap fit element positioned between the second tab and the second hook approximately along the transverse direction.

2. The dishwasher appliance of claim 1, wherein the first center tab comprises a first proximal end attached to the first universal inner member and a first distal end free from the first universal inner member, wherein the first distal end is engaged with the first roller bracket to attach the first roller bracket to the first universal inner member, wherein the second center tab comprises a second proximal end attached to the second universal inner member and a second distal end free from the second universal inner member, and wherein the second distal end is engaged with the second roller bracket to attach the second roller bracket to the second universal inner member.

3. The dishwasher appliance of claim 1, wherein the first center snap fit element comprises a first secured end attached to the first roller bracket and a first free end, wherein the first center snap fit element is biased toward an offset position, wherein in the offset position the first free end is offset approximately along the lateral direction from the first roller bracket, wherein the second center snap fit element comprises a second secured end attached to the second roller bracket and a second free end, wherein the second center snap fit element is biased toward an offset position, and wherein in the offset position the second free end is offset approximately along the lateral direction from the second roller bracket.

4. The dishwasher appliance of claim 3, wherein the first roller bracket comprises a first front protruded portion, a first center protruded portion, and a first back protruded portion, and wherein the first secured end of the first center snap fit element is attached to the first center protruded portion, wherein the second roller bracket comprises a second front protruded portion, a second center protruded portion, and a second back protruded portion, and wherein the second secured end of the second center snap fit element is attached to the second center protruded portion.

5. The dishwasher appliance of claim 1, wherein the first roller bracket is located to the first universal inner member by the first tab sliding through the first front slot and wherein the second roller bracket is located to the second universal inner member by the second tab sliding through the second front slot.

6. The dishwasher appliance of claim 1, wherein the first roller bracket is locked to the first universal inner member by the first center tab interfacing with the first center snap fit element and wherein the second roller bracket is locked to the second universal inner member by the second center tab interfacing with the second center snap fit element.

7. The dishwasher appliance of claim 1, wherein the first roller bracket is attached to the first universal inner member by the first hook interfacing with the first universal inner member and wherein the second roller bracket is attached to the second universal inner member by the second hook interfacing with the second universal inner member.

8. A dishwasher appliance comprising:

a tub comprising a tub side wall; and a slide assembly mounted to the tub side wall, the slide assembly comprising:

a universal inner member comprising a front slot, a back slot, and a center tab, the front slot and the back slot each defined the universal inner member, the center tab located between the front slot and the back slot approximately along a first direction; and a roller bracket attached to the universal inner member, the roller bracket extending from a front end to a back end approximately along the first direction, the roller bracket comprising a tab positioned at the front end, a hook positioned at the back end, and a center snap fit element positioned between the tab and the hook approximately along the first direction.

9. The dishwasher appliance of claim 8, wherein the center tab comprises a first end attached to the universal inner member and a second end free from the universal inner member and wherein the center tab of the universal inner member is engaged with the roller bracket to attach the roller bracket to the universal inner member.

10. The dishwasher appliance of claim 8, wherein the center snap fit element comprises a secured end attached to the roller bracket and a free end, wherein the center snap fit element is biased toward an offset position, wherein in the offset position the free end is offset approximately along a second direction from the roller bracket, and wherein the second direction is approximately perpendicular to the first direction.

11. The dishwasher appliance of claim 10, wherein the roller bracket comprises a front protruded portion, a center protruded portion, and a back protruded portion, and wherein the secured end of the center snap fit element is attached to the center protruded portion.

12. The dishwasher appliance of claim 8, wherein the roller bracket is located to the universal inner member by the tab sliding through the front slot.

13. The dishwasher appliance of claim 8, wherein the roller bracket is locked to the universal inner member by the center tab interfacing with the center snap fit element.

14. The dishwasher appliance of claim 8, wherein the roller bracket is attached to the universal inner member by the hook interfacing with the universal inner member.

* * * * *